US005217399A

United States Patent [19]

Strang

[11] Patent Number: 5,217,399

[45] Date of Patent: Jun. 8, 1993

[54] AUTOMATIC POWER TRIM DEVICE

[75] Inventor: Charles D. Strang, Antioch, Ill.

[73] Assignee: Outboard Marine Corporation, Waukegan, Ill.

[21] Appl. No.: 773,231

[22] Filed: Oct. 9, 1991

[51] Int. Cl.[5] ..... B63B 5/12

[52] U.S. Cl. ..... 440/61; 440/40

[58] Field of Search ..... 440/1, 53, 61, 2, 40–43; 114/286, 287, 277, 162

[56] References Cited

U.S. PATENT DOCUMENTS

| | | | |
|---|---|---|---|
| 2,627,181 | 2/1953 | Kiekhaefer | 440/2 |
| 2,709,979 | 6/1955 | Busa et al. | 114/277 |
| 3,046,928 | 7/1962 | Sherrill | 114/66.5 |
| 3,468,282 | 9/1969 | Wintercorn | 115/41 |
| 3,982,494 | 9/1976 | Posti | 440/41 |
| 3,994,253 | 11/1976 | Mathewson | 114/277 |
| 4,318,699 | 3/1982 | Wenstadt et al. | 440/1 |
| 4,718,872 | 1/1988 | Olson et al. | 440/1 |
| 4,861,292 | 8/1989 | Griffiths et al. | 440/1 |
| 4,872,857 | 10/1989 | Newman et al. | 440/1 |
| 4,939,660 | 7/1990 | Newman et al. | 364/442 |

FOREIGN PATENT DOCUMENTS

| | | | |
|---|---|---|---|
| 0247997 | 10/1987 | Japan | 440/42 |
| 0703421 | 12/1979 | U.S.S.R. | 440/42 |

*Primary Examiner*—Sherman Basinger
*Attorney, Agent, or Firm*—Michael, Best & Friedrich

[57] ABSTRACT

Marine apparatus comprising a member adapted to be mounted on a boat for pivotal movement relative thereto about an axis, and control structure for causing pivotal movement of the member about the axis, the structure including a hydraulic assembly having one end adapted to engage the boat and an opposite end engaging the member, the hydraulic assembly including a cylinder, a piston dividing the cylinder into first and second chambers, and a piston rod which is fixed to the piston and which extends through the second chamber, and structure utilizing water pressure created by relative movement between the boat and the body of water in which the boat is operating for pressurizing the hydraulic assembly, the pressurizing structure including a conduit having one end which opens forwardly and which is adapted to communicate with the body of water, and having an opposite end communicating with the first chamber, and the pressurizing structure permitting the pressure in the first chamber to decrease in response to decreasing water pressure at the one end of the conduit.

18 Claims, 2 Drawing Sheets

AUTOMATIC POWER TRIM DEVICE

BACKGROUND OF THE INVENTION

The invention relates to hydraulic assemblies used in connection with marine apparatus. The invention also relates to systems for controlling the trim of a marine propulsion device.

It is known to automatically control the trim of a marine propulsion device in response to various conditions, such as boat speed. See, for example, U.S. Pat. No. 4,718,872.

Attention is also directed to the following U.S. patents:

| | | |
|---|---|---|
| Sherrill | 3,046,928 | July 31, 1962 |
| Wintercorn | 3,468,282 | September 23, 1969 |
| Wenstadt et al. | 4,318,699 | March 9, 1982 |
| Olson et al. | 4,718,872 | January 12, 1988 |
| Griffiths et al. | 4,861,292 | August 29, 1989 |
| Newman et al. | 4,872,857 | October 10, 1989 |
| Newman et al. | 4,939,660 | July 3, 1990 |

SUMMARY OF THE INVENTION

The invention provides a marine propulsion device comprising a propulsion unit adapted to be mounted on a boat for pivotal movement relative thereto about a generally horizontal tilt axis, the propulsion unit including a propeller shaft adapted to support a propeller, and means for causing pivotal movement of the propulsion unit about the tilt axis, the means including a hydraulic assembly having one end adapted to engage the boat and an opposite end engaging the propulsion unit, and means utilizing water pressure created by relative movement between the boat and the body of water in which the boat is operating for pressurizing the hydraulic assembly.

One embodiment of the invention provides a marine propulsion device comprising a propulsion unit adapted to be mounted on a boat for pivotal movement relative thereto about a generally horizontal tilt axis and between a trimmed-in position and a trimmed-out position, the propulsion unit including a propeller shaft adapted to support a propeller, and means for maintaining the propulsion unit in the trimmed-in position while boat speed is below a predetermined speed, and for moving the propulsion unit from the trimmed-in position to the trimmed-out position when boat speed exceeds the predetermined speed.

One embodiment of the invention provides marine apparatus comprising a member adapted to be mounted on a boat for pivotal movement relative thereto about an axis, and means for causing pivotal movement of the member about the axis, the means including a hydraulic assembly having one end adapted to be the boat and an opposite end engaging the member, the hydraulic assembly including a cylinder, a piston dividing the cylinder into first and second chambers, and a piston rod which is fixed to the piston and which extends through the second chamber, and means utilizing water pressure created by relative movement between the boat and the body of water in which the boat is operating for pressurizing the hydraulic assembly, the pressurizing means including a conduit having one end which opens forwardly and which is adapted to communicate with the body of water and having an opposite end communicating with the first chamber, and the pressurizing means permitting the pressure in the first chamber to decrease in response to decreasing water pressure at the one end of the conduit.

A principal feature of the invention is the provision of a trim control system for maintaining a propulsion unit in a trimmed-in position while boat speed is below a predetermined speed, and for moving the propulsion unit from the trimmed-in position to a trimmed-out position when boat speed exceeds the predetermined speed.

Another principal feature of the invention is the provision of means utilizing water pressure created by relative movement between a boat and the body of water in which the boat is operating for pressurizing a hydraulic trim assembly.

Other features and advantages of the invention will become apparent to those skilled in the art upon review of the following detailed description, claims and drawings.

Figure 1:
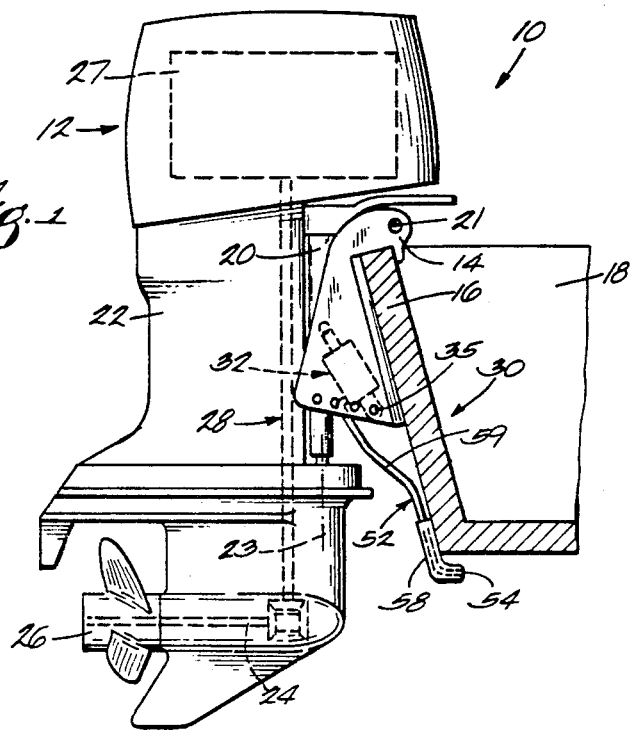
FIG. 1 is a side elevational view of a marine propulsion device including an automatic trim control device embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

Figure 2:
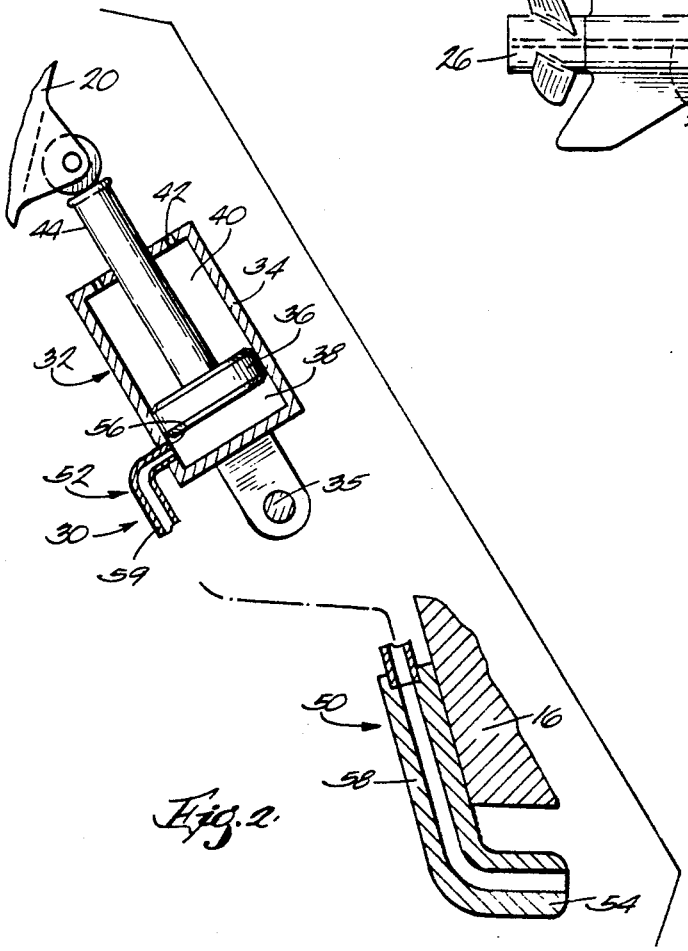
FIG. 2 is a view, partially in section, of the device.

A marine apparatus 10 embodying the invention is illustrated in FIGS. 1 and 2. The marine apparatus 10 comprises a marine propulsion device which, in the illustrated construction, is an outboard motor 12 (FIG. 1). The outboard motor 12 includes a transom bracket 14 fixedly mounted on the transom 16 of a boat 18. The outboard motor 12 also includes a swivel bracket or member 20 mounted on the transom bracket 14 for pivotal movement relative thereto about a generally horizontal tilt axis 21. The outboard motor 12 further includes a propulsion unit 22 mounted on the swivel bracket 20 for pivotal movement relative thereto about a generally vertical steering axis 23. The propulsion unit 22 includes a propeller shaft 24 supporting a propeller 26, and an engine 27 drivingly connected to the propeller shaft 24 by a conventional drive train 28. The swivel bracket 20 and the connected propulsion unit 22 are pivotable about the tilt axis 21 between a trimmed-in position (shown in FIG. 1) and a trimmed-out position (not shown), as is known in the art.

The marine apparatus 10 also comprises trim control means 30 for maintaining the propulsion unit 22 in the trimmed-in position while boat speed is below a predetermined speed, for moving the propulsion unit 22 from the trimmed-in position to the trimmed-out position when boat speed exceeds the predetermined speed, and for moving the propulsion unit 22 from the trimmed-out position to the trimmed-in position when boat speed falls below the predetermined speed.

While various suitable trim control means 30 can be employed, in the illustrated construction such means includes (see FIG. 2) a hydraulic assembly 32 having one end engaging the boat 18 and an opposite end engaging the propulsion unit 22. In the preferred embodiment, one end of the hydraulic assembly 32 engages the transom bracket 14, and the opposite end of the hydraulic assembly 32 engages the swivel bracket 20. While the hydraulic assembly 32 can have any suitable construction, the illustrated assembly 32 is a piston/cylinder assembly. Another type of hydraulic assembly, such as a bellows assembly, could be used. The illustrated hydraulic assembly 32 includes a cylinder 34 connected to the transom bracket 14. Preferably, a trim pin 35 is locatable in a plurality of positions relative to the transom bracket 14, as is known in the art, and the cylinder 34 is pivotally mounted on the trim pin 35. Movement of the trim pin 35 adjusts the trimmed-out position of the propulsion unit 22, because movement of the trim pin 35 adjusts the position of the cylinder 34 relative to the transom bracket 14. The hydraulic assembly 32 also includes a piston 36 dividing the cylinder 34 into first and second or lower and upper chambers 38 and 40. The upper chamber 40 communicates with the atmosphere, such as by holes 42 through the end of the cylinder 34. The assembly 32 also includes a piston rod 44 which is fixed to the piston 36 and which extends through the upper chamber 40. The outer end of the piston rod 44 engages or abuts the swivel bracket 20 in a manner known in the art. Alternatively, the outer end of the piston rod 44 could be pivotally connected to the swivel bracket 20.

The trim control means 30 also includes means 50 utilizing water pressure created by relative movement between the boat and the body of water in which the boat is operating for pressurizing the hydraulic assembly 32. The pressurizing means 50 preferably includes a conduit 52 having a lower end 54 which opens forwardly and which communicates with the body of water, and having an opposite or upper end 56 communicating with the lower chamber 38 of the cylinder 34. The conduit 52 preferably includes a rigid lower portion 58 which is fixed to the bottom of the boat transom 16 and which includes the lower end 54 of the conduit 52. The conduit 52 also includes a flexible upper portion 59 communicating between the lower portion and the cylinder chamber 38.

Figure 5:
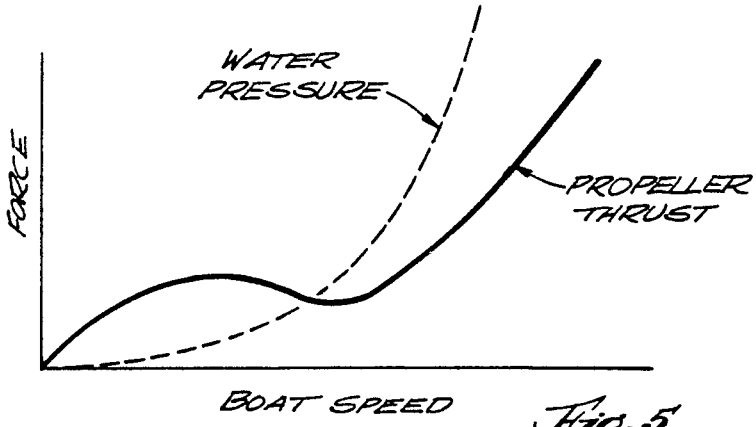
FIG. 5 is a graph showing the forces generated by water pressure and propeller thrust as functions of boat speed.

The water pressure at the lower end 54 of the conduit 52 and thus in the cylinder chamber 38 increases with the boat speed at approximately the square of the increase in the boat speed. The opposing force on the piston 36 is the thrust exerted on the piston rod 44 by the propulsion unit 22 as it drives the boat 18 forward. This latter force increases rapidly at low speeds and less rapidly thereafter. These forces are shown as functions of boat speed on the graph in FIG. 5.

While the boat 18 is running at low speed, the force on the piston 36 due to pressure communicated through the conduit 52 to the first chamber 38 is negligible relative to the force on the piston 36 created by the thrust of the propulsion unit 22. As a result, the piston 36 is pushed into the cylinder 34, thus pivoting the propulsion unit 22 toward the boat transom 16, to the trimmed-in position. As the boat speed increases the pressure in the cylinder chamber 38 increases. At the predetermined speed the pressure in the cylinder chamber 38 exerts on the piston 36 a force which is greater than the force on the piston 36 as a result of the thrust of the propulsion unit 22. The piston 36 is therefore forced outward, and the propulsion unit 22 pivots away from the boat transom 16, to the trimmed-out position. The propulsion unit 22 stays in the trimmed-out position as the boat speed continues to increase. The trimmed-out position should be well suited for boat operation under planing or high speed conditions.

During deceleration the propulsion unit 22 stays in the trimmed-out position until the boat speed falls below the predetermined speed. The process is reversed at that point, and the propulsion unit 22 returns to the trimmed-in position for low speed operation.

The conduit 52 thus causes the pressure in the cylinder chamber 38 to increase in response to increasing water pressure at the lower end 54 of the conduit 52 and permits the pressure in the cylinder chamber 38 to decrease in response to decreasing water pressure at the lower end 54 of the conduit trim control means 30 is simple, inexpensive and lightweight and automatically alters the trim angle of the propulsion unit 22 with boat speed.

Figure 3:
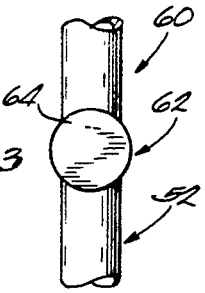
FIG. 3 is a partial sectional view of an alternative embodiment of the invention.

A marine apparatus 60 that is an alternative embodiment of the invention is partially illustrated in FIG. 3. Except as described below, the marine apparatus 60 is substantially identical to the marine apparatus 10, and common elements have been given the same reference numerals.

In the marine apparatus 60, the trim control means 30 includes selectively operable means 62 for closing the conduit 52 and thereby maintaining the pressure in the cylinder chamber 38. While various suitable means 62 can be employed, in the illustrated construction, such means 62 includes a simple manually operable valve 64 (shown schematically) located in the conduit 52 between the lower and upper ends 54 and 56 of the conduit 52. When closed, the valve 64 prevents communication between the cylinder chamber 38 and the lower end 54 of the conduit 52 and thereby substantially locks the propulsion unit 22 in place. The operator can thus "lock" the propulsion unit 22 in either the trimmed-in position or the trimmed-out position.

Figure 4:
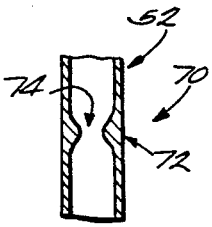
FIG. 4 is a partial sectional view of a second alternative embodiment of the invention.

A marine apparatus 70 that is a second alternative embodiment of the invention is partially illustrated in FIG. 4. Except as described below, the marine apparatus 70 is substantially identical to the marine apparatus 10, and common elements have been given the same reference numerals.

In the marine apparatus 70, the trim control means 30 includes means 72 for restricting the rate of fluid flow through the conduit 52. While various suitable means 72 can be employed, in the illustrated construction, such means 72 includes a restriction or orifice 74 in the conduit 52. Restricting the rate of fluid flow through the conduit 52 restricts the rate at which the propulsion unit 22 moves between the trimmed-in and trimmed-out positions. This may be desirable in order to prevent the propulsion unit 22 from moving too quickly from the trimmed-in position to the trimmed-out position, or vice versa.

Figure 6:
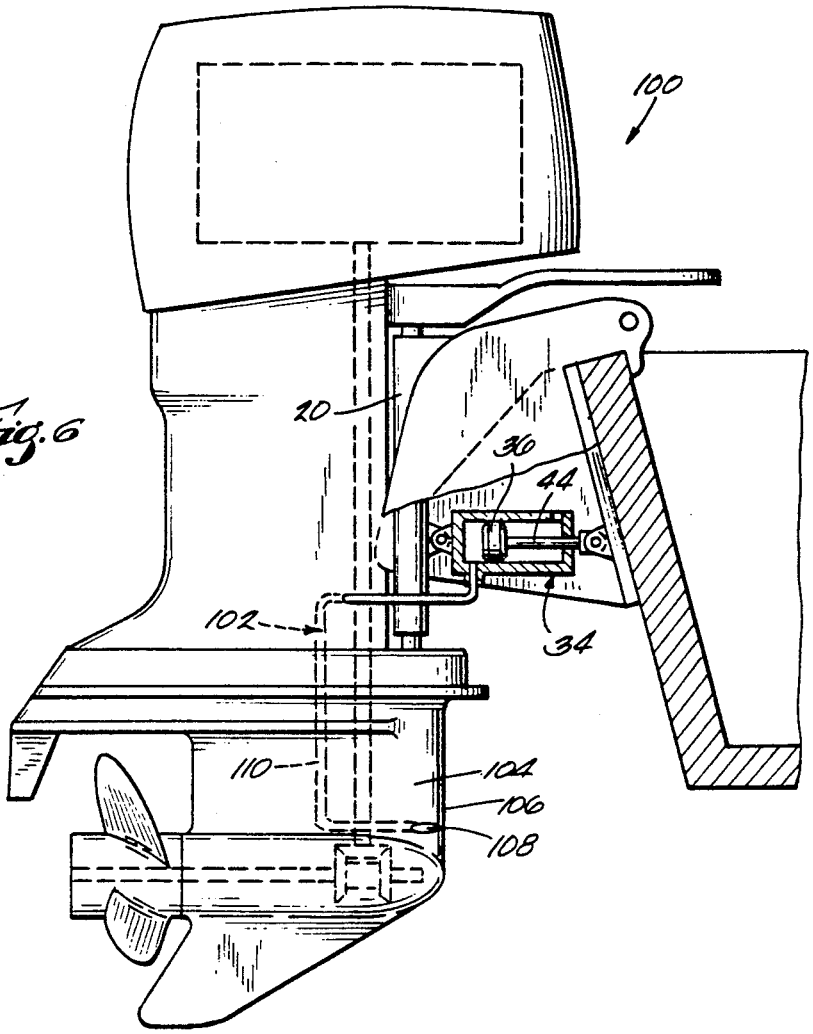
FIG. 6 is an elevational view, partially in section, of a third alternative embodiment of the invention.

A marine apparatus 100 that is a third alternative embodiment of the invention as illustrated in FIG. 6. Except as described below, the marine apparatus 100 is substantially identical to the marine apparatus 10, and common elements have been given the same reference numerals.

In the marine apparatus 100, the cylinder 34 is pivotally connected to the swivel bracket 20 and the piston rod 44 is pivotally connected to the transom bracket 14. Instead of the conduit 52 of the marine apparatus 10, the marine apparatus 100 includes conduit means 102 extending at least in part internally of the propulsion unit 22. As shown in FIG. 6, the propulsion unit 22 includes a drive shaft housing 104 having a leading edge or forward surface 106. The forward surface 106 has therein an opening 108 communicating with the body of water, and a conduit 110 extends internally of the drive shaft housing 104 from the opening 108 to a point adjacent the swivel bracket 20. From this point the conduit 110 extends externally of the drive shaft housing 104 to the cylinder 34. The portion of the conduit 110 that is external to the drive shaft housing 104 is preferably flexible in order to accommodate relative movement between the cylinder 34 and the drive shaft housing 104.

In another alternative embodiment of the invention (not shown), a mechanical linkage (such as a lever or a gear) can be interposed between the piston rod 44 and the swivel bracket 20 so as to provide a mechanical advantage allowing the area of the piston 36 to be reduced, thereby avoiding the need for an extremely large or ungainly piston.

Various features of the invention are set forth in the following claims.

What is claimed is:

1. A marine propulsion device comprising a propulsion unit adapted to be mounted on a boat for pivotal movement relative thereto about a generally horizontal tilt axis, said propulsion unit including a propeller shaft adapted to support a propeller, and means for causing pivotal movement of said propulsion unit about said tilt axis and including a cylinder/piston assembly having one end adapted to be connected to the boat and an opposite end connected to said propulsion unit, and including a cylinder and a piston rod movable relative to said cylinder, said cylinder/piston assembly being operable, in response, to outward movement of said piston rod relative to said cylinder, to upwardly and outwardly tilt said propulsion unit relative to the boat, a conduit having one end which opens forwardly, which is adapted to communicate with the body of water in which the boat is operating, and which is subject to the water pressure created by relative movement between the boat and the body of water, and having an opposite end communicating with said cylinder/piston assembly, whereby to afford flow of water from the body of water to said cylinder/piston assembly so as to outwardly move said piston rod relative to said cylinder.

2. A marine propulsion device as set forth in claim 1 wherein said cylinder/piston assembly includes a piston dividing said cylinder into first and second chambers wherein said piston rod is fixed to said piston and which extends through said second chamber, and wherein said opposite end of said conduit communicates with said first chamber.

3. A marine propulsion device as set forth in claim 2 wherein said conduit permits the pressure in said first chamber to decrease in response to decreasing water pressure at said one end of said conduit.

4. A marine propulsion device as set forth in claim 2 wherein said second chamber communicates with the atmosphere.

5. A marine propulsion device as set forth in claim 1 wherein said means includes selectively operable means for closing said conduit and thereby maintaining the pressure in said cylinder/piston assembly.

6. A marine propulsion device as set forth in claim 1 wherein said conduit includes means for restricting the rate of fluid flow through said conduit.

7. A marine propulsion device as set forth in claim 1 wherein at least a portion of said conduit extends internally of said propulsion unit.

8. A marine propulsion device comprising a propulsion unit adapted to be mounted on a boat for pivotal movement relative thereto about a generally horizontal tilt axis and between a trimmed-in position and a trimmed-out position, said propulsion unit including a propeller shaft adapted to support a propeller, and trim control means for maintaining said propulsion unit in said trimmed-in position while boat speed is below a predetermined speed, and for moving said propulsion unit from said trimmed-in position to said trimmed-out position when boat speed exceeds said predetermined speed, said trim control means including a cylinder/piston assembly having one end adapted to engage the boat, an opposite end engaging said propulsion unit, and being operative to trim out said propulsion unit in response to an increase in distance between said cylinder/piston assembly ends, and to trim in said propulsion unit in response to a decrease in distance between said cylinder/piston ends, and a conduit having one end communicating with said cylinder/piston assembly and a second end which opens forwardly to admit water from the body of water in which a boat is operating so as thereby to afford flow of water from the body to the cylinder/piston assembly and so as thereby to increase and decrease the distance between said cylinder/piston assembly ends incident to variation in boat speed.

9. A marine propulsion device as set forth in claim 8 wherein said means moves said propulsion unit from said trimmed-out position to said trimmed-in position when boat speed falls below said predetermined speed.

10. A marine propulsion device as set forth in claim 8 wherein said hydraulic assembly includes a cylinder, a piston dividing said cylinder into first and second chambers, and a piston rod which is fixed to said piston and which extends through said second chamber, and wherein said one end of said conduit communicates with said first chamber.

11. A marine propulsion device as set forth in claim 10 wherein said conduit permits the pressure in said first chamber to decrease in response to decreasing water pressure at said second end of said conduit.

12. A marine propulsion device as set forth in claim 10 wherein said second chamber communicates with the atmosphere.

13. A marine propulsion device as set forth in claim 8 wherein said trim control means includes selectively operable means for closing said conduit and thereby maintaining the pressure in said cylinder/piston assembly.

14. A marine propulsion device as set forth in claim 8 wherein said trim control means includes means for restricting the rate of fluid flow through said conduit.

15. Marine apparatus comprising a propulsion unit adapted to be mounted on a boat for pivotal movement relative thereto about an axis, and control means for causing pivotal movement of said propulsion unit about said axis between a trimmed-in position and a trimmed-out position, said means including a hydraulic assembly having one end engaging said propulsion unit, said hydraulic assembly including a cylinder, a piston dividing said cylinder into first and second chambers, and a piston rod which is fixed to said piston and which extends through said second chamber, said control means being operative to trim out said propulsion unit in response to an increase in length of said hydraulic assembly, and to trim in said propulsion unit in response to a decrease in length of said hydraulic assembly, and means utilizing water pressure created by relative movement between the boat and the body of water in which the boat is operating for pressurizing said hydraulic assembly, said pressurizing means including a conduit having one end which opens forwardly and which is adapted to communicate with the body of water, and having an opposite end communicating with said first chamber, and said pressurizing means permitting variation in the pressure in said first chamber in response to variation in the water pressure at said one end of said conduit.

16. Marine apparatus as set forth in claim 15 wherein said second chamber communicates with the atmosphere.

17. Marine apparatus as set forth in claim 15 wherein said control means includes selectively operable means for closing said conduit and thereby maintaining the pressure in said first chamber.

18. Marine apparatus as set forth in claim 15 wherein said control means includes means for restricting the rate of fluid flow through said conduit.

* * * * *